US008377527B2

(12) United States Patent
Winkler

(10) Patent No.: US 8,377,527 B2
(45) Date of Patent: Feb. 19, 2013

(54) HIGH-TEMPERATURE-STABLE HOLLOW PROFILE

(75) Inventor: Erhard Winkler, Rodental (DE)

(73) Assignee: Saint-Gobain Industriekeramik Roedental GmbH, Roedental (DE)

( * ) Notice: Subject to any disclaimer, the term of this patent is extended or adjusted under 35 U.S.C. 154(b) by 124 days.

(21) Appl. No.: 12/854,833

(22) Filed: Aug. 11, 2010

(65) Prior Publication Data

US 2011/0059276 A1 Mar. 10, 2011

(51) Int. Cl.
*A47G 19/22* (2006.01)

(52) U.S. Cl. ..... 428/34.4; 52/843

(58) Field of Classification Search ..... 52/843, 52/831; 432/126; 428/34.1, 34.4
See application file for complete search history.

(56) References Cited

U.S. PATENT DOCUMENTS

| | | | | |
|---|---|---|---|---|
| 2,167,764 | A * | 8/1939 | Lytle | 52/307 |
| 4,738,058 | A * | 4/1988 | Svensson | 52/98 |
| 5,175,971 | A * | 1/1993 | McCombs | 52/843 |
| 5,175,973 | A * | 1/1993 | Owen et al. | 52/741.14 |
| 7,228,672 | B2 * | 6/2007 | Hayes et al. | 52/843 |
| 7,717,705 | B2 * | 5/2010 | Erhard | 432/258 |
| 2008/0193891 | A1 * | 8/2008 | Erhard | 432/258 |
| 2011/0059276 | A1 * | 3/2011 | Winkler | 428/34.1 |

* cited by examiner

*Primary Examiner* — N. Edwards
(74) *Attorney, Agent, or Firm* — Steinfl & Bruno LLP

(57) ABSTRACT

A high-temperature-stable hollow profile is described. The hollow profile is provided with side walls and transverse walls. Wall thicknesses of the side walls and of the transverse walls increase in cross-section from a central region to a corner region of the hollow profile.

20 Claims, 4 Drawing Sheets

HIGH-TEMPERATURE-STABLE HOLLOW PROFILE

CROSS REFERENCE TO RELATED APPLICATIONS

The present application claims priority to German utility model application 202009012119.4 filed on Sep. 5, 2009 and incorporated herein by reference in its entirety.

FIELD

The present disclosure relates to hollow profiles. More in particular, it relates to a high-temperature-stable hollow profile.

BACKGROUND

Hollow profiles with thermally stable properties are used, for example, as force-bearing mountings for process goods or as kiln accessories in high temperature processes. The hollow profiles have, preferably, round, rounded, or rectangular cross-sections. The hollow profiles are exposed during manufacture and use to mechanical and thermomechanical loads under high temperatures or temperature change cycles. Appropriate rigidity against point, line, and area loads and high stability, in particular against point loads in the itch region, are necessary. An additional problem occurs with unsintered and mechanically unstable pre-products of the hollow profile in the manufacturing process. The pre-products may be plastically deformed under their own weight. To minimize the problems, according to the prior art, very thick wall thicknesses have been selected for hollow profiles.

SUMMARY

According to a first aspect of the present disclosure, a high-temperature-stable hollow profile with side walls and transverse walls is provided, wherein wall thicknesses of the side walls and of the transverse walls increase in cross-section from a central region to a corner region of the hollow profile.

Further embodiments of the present disclosure are provided in the specification, claims and drawings of the present application.

BRIEF DESCRIPTION OF THE DRAWINGS

A comparative example according to the prior art is depicted in FIG. 1. Exemplary embodiments of the invention are explained with reference to FIG. 2 through 4.

FIG. 1 depicts a comparative example of a hollow profile beam (1) for use as a high-temperature-stable support in kilns. The beam (1) contains reaction-bonded silicon infiltrated SiSiC. The beam (1) has a square cross-section and an external width (B) and height (H) of 100 mm. The length (L) of the beam (1) is 2000 mm. Inside and outside corners (5) of the beam (1) are rounded. Side walls (3) and transverse walls (6) have a wall thickness of 10 mm and formed a roughly square hollow space (2). The unsintered pre-product has, during handling after extrusion, deformations on the side walls (3) and, in particular, on the upper transverse wall (6).

FIG. 2 and FIG. 4 depict a hollow profile beam (1) according to several embodiments of the disclosure. The beam (1) can be extruded with a silicon carbide-containing mass and then sintered to form reaction-bonded silicon infiltrated SiSiC. The hollow profile beam (1) has, for example, an external width (B) and height (H) of 100 mm. The length (L) of the beam (1) of the example is 2000 mm. The outside edges are likewise rounded. The internal dimensions and wall thicknesses (3, 6) differ, in accordance with the disclosure, from the prior art. By way of example, the side walls (3) and the transverse walls (6) have in the central region (4) a wall thickness of roughly 6.5 mm. The wall thicknesses of the side walls (3) and transverse walls (6) increase into the corner regions (5) and toward the hollow space (2) at an angle (T) of, e.g., roughly 13°. The angle (T) is measured between an extrapolated inside edge (7) of the central region (4) and an extrapolated inside edge (8) of the corner region (5). In the example shown in the figures, the central regions (4) have a length (L4) of 20 mm. The side walls (3) and transverse walls (6) can form, in cross-section, a shape with 12 edges, with the shape highly rounded in the corner regions (5).

Figure 1:
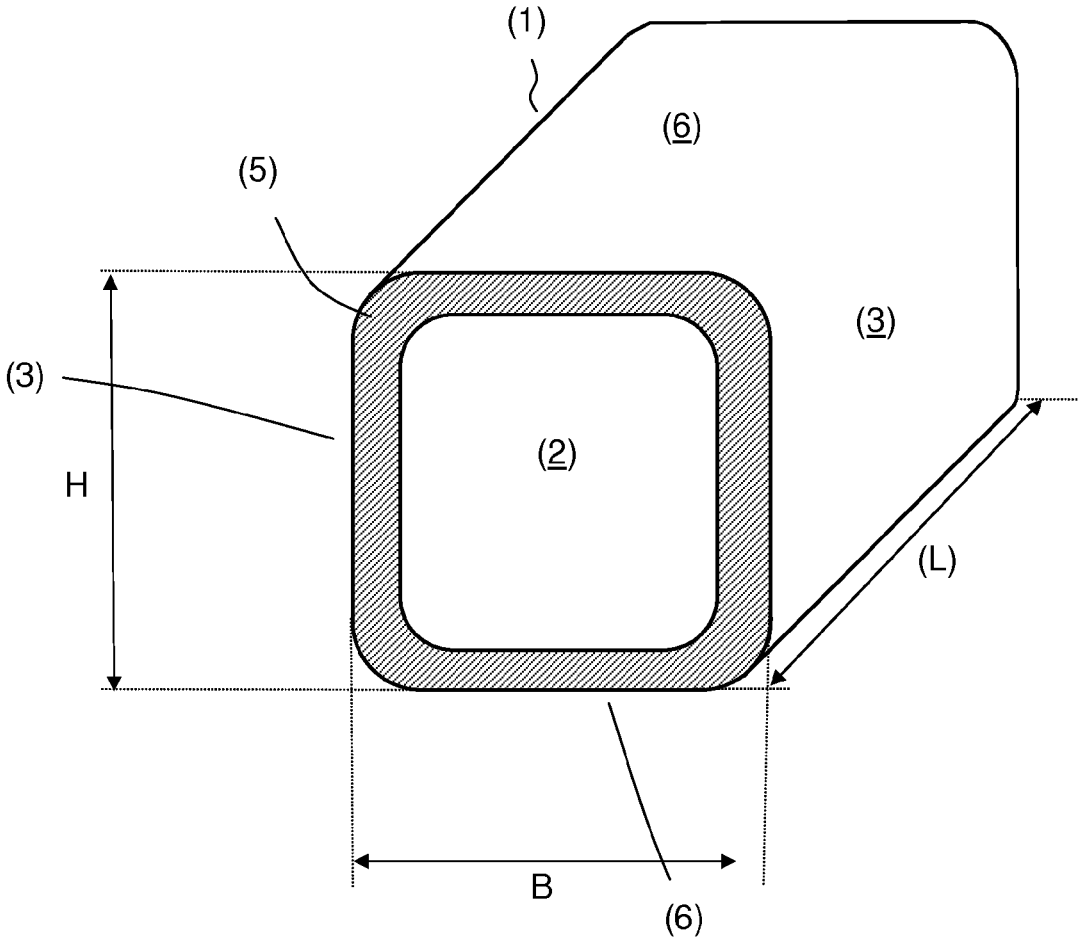
Fig. 1 Prior Art
FIG. 1 shows a spherical view of a hollow profile, in this case, a beam, according to the prior art.
Figure 2:
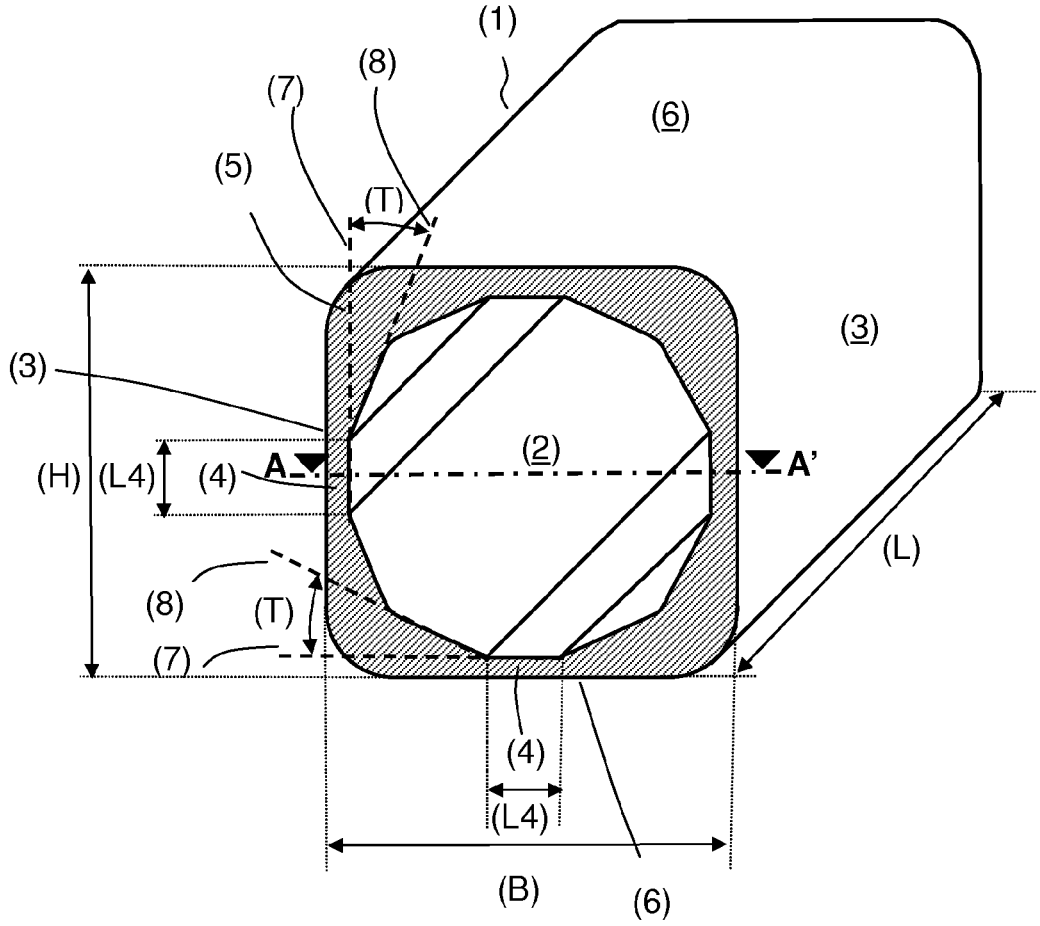
FIG. 2 shows a spherical view of a square hollow profile, in this case, a beam, according to the disclosure.

According to several embodiments, the unsintered pre-product of the square hollow profile beam according to the disclosure (1) has, after extrusion, no plastic deformations on the side walls (3) and transverse walls (6). In the sintered state, embodiments of the hollow profile beam (1) have, in comparison to the prior art, increased rigidity against point, line, area, twist, and shear loads as well as increased stability, in particular against point loads in the corner region (5).

Figure 3:
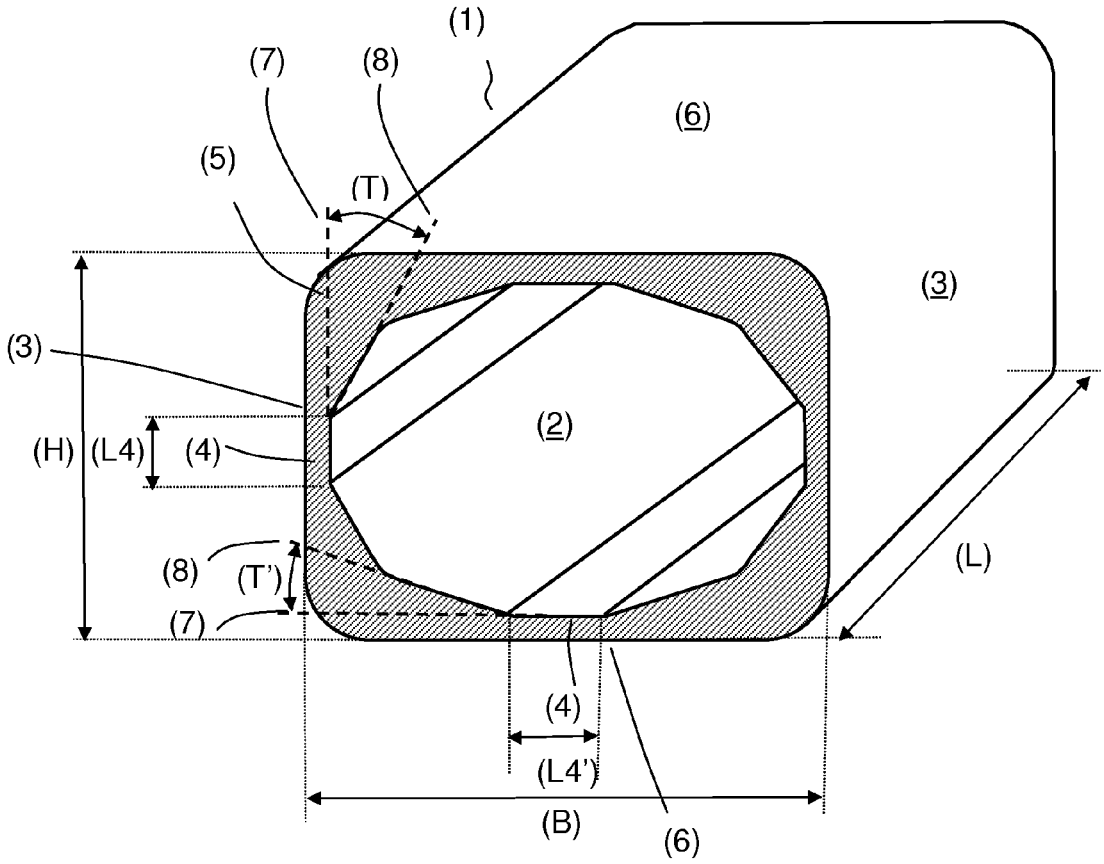
FIG. 3 shows a spherical view of a rectangular hollow profile, in this case, a beam, according to the disclosure, and FIG. 4 a cross-section through a spherical view of a square hollow profile, represented in FIG. 2 along the line A-A'.
Figure 4:
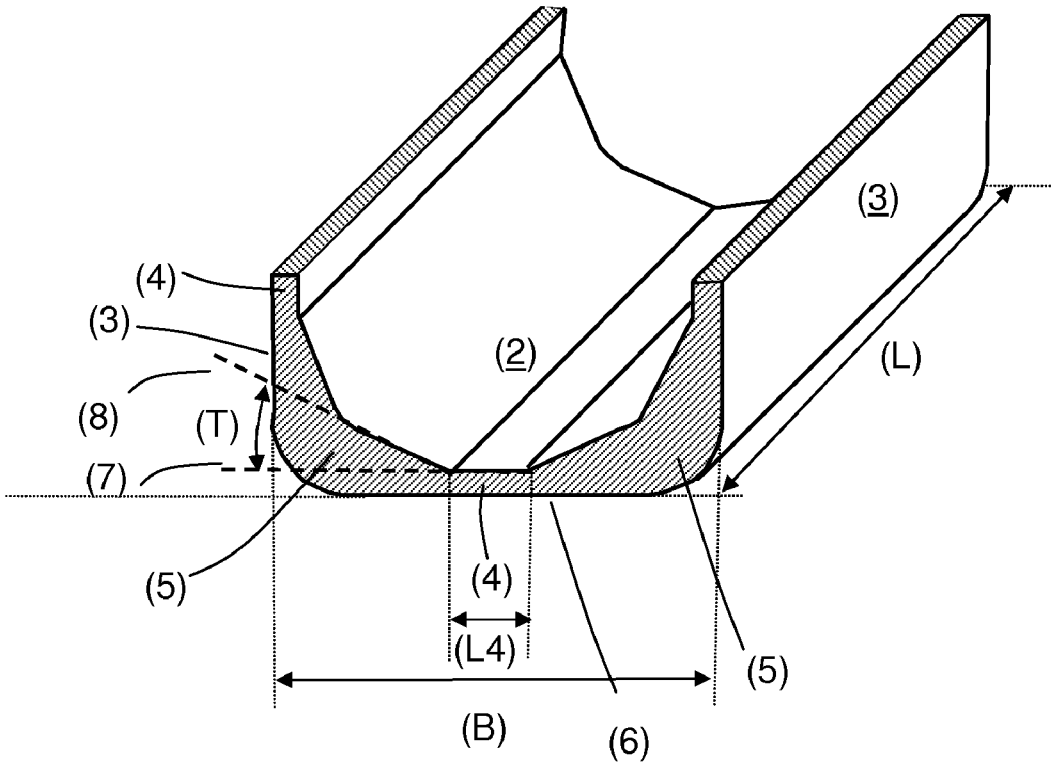

FIG. 3 depicts a hollow profile beam (1) according to an embodiment of the disclosure with a rectangular cross-section. By way of example, the beam (1) is likewise produced with reaction-bonded silicon infiltrated SiSiC and can have a height (H) of 100 mm and a width (B) of 150 mm. In such example, the length (L) of the beam (1) is 2000 mm. The outside edges are rounded. By way of example, the side walls (3) and transverse walls (6) have in the central region (4) a wall thickness of roughly 7 mm. Toward the corner regions (5) and toward the hollow space (2) the wall thicknesses of the side walls (3) increase at an angle (T) of roughly 13°. The wall thicknesses of the transverse walls (6) increase at an angle (T') that is smaller than the angle (T). The angles (T, T') are measured between extrapolated inside edges (7) of the central regions (4) and extrapolated inside edges (8) of the corner regions (5). By way of example, the central region (4) of the side walls (3) can have a length (L4) of 18 mm. The central region (4) of the transverse walls (6) can have a length (L4') of roughly 30 mm.

According to several embodiments, the unsintered pre-product of the rectangular hollow profile beam (1) has, after extrusion, no deformations on the side walls (3) and the transverse walls (6). The sintered hollow profile beam (1) has, in comparison with the prior art, increased rigidity against point, line, area, twist, and shear loads as well as increased stability, in particular against point loads in the corner region (5).

In accordance with several embodiments of the present disclosure, the unsintered pre-products of the hollow profiles (1) have, after extrusion, no deformations. The hollow profiles (1) according to such embodiments are, in comparison with the prior art, more resistant to mechanical and thermomechanical loads with reduced use of material and reduced weight.

The examples set forth above are provided to give those of ordinary skill in the art a complete disclosure and description of how to make and use the embodiments of the high-temperature-stable hollow profile of the disclosure, and are not intended to limit the scope of what the inventors regard as their disclosure. Modifications of the above-described modes for carrying out the disclosure may be used by persons of skill in the art, and are intended to be within the scope of the following claims. All patents and publications mentioned in the specification may be indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications may be made without departing from the spirit and scope of the present disclosure. Accordingly, other embodiments are within the scope of the following claims.

List of reference numerals and characters (1) Hollow profile
(2) Hollow space
(3) Side wall
(4) Central region
(5) Corner region
(6) Transverse wall
(7) Extrapolated inside edge of the central region (4)
(8) Extrapolated inside edge of the corner region (5)
(B) Width of the hollow profile
(H) Height of the hollow profile
(L) Length of the hollow profile
(T)(T') Angles of expansion from the central region to the corner region
(L4)(L4') Lengths of the central region in cross-section

The invention claimed is:

1. A high-temperature-stable hollow profile comprising as least one of silicon carbide, silicon nitride, and mullite, the high-temperature-stable hollow profile having side walls and transverse walls, wherein:

the side walls meet the transverse walls to form a substantially polygonal cross-section, and wall thicknesses of the side walls and of the transverse walls increase in cross-section from a central region to a corner region of the hollow profile.

2. The high-temperature-stable hollow profile according to claim 1, wherein the wall thicknesses of the side walls and of the transverse walls increase in cross-section from the central region to the corner region and toward a hollow space of the hollow profile.

3. The high-temperature-stable hollow profile according to claim 1, wherein the wall thicknesses of the side walls and the transverse walls increase in cross-section with an angle formed between an extrapolated edge of the central region on the inside of the hollow profile and an extrapolated edge of the corner region on the inside of the hollow profile.

4. The high-temperature-stable hollow profile according to claim 1, in which in cross-section the side walls and transverse walls have in the central region a constant wall thickness.

5. The high-temperature-stable hollow profile according to claim 1, wherein the hollow profile has at least one of a width of 30 mm to 200 mm, a height of 30 mm to 200 mm, or a length of 200 mm to 6000 mm.

6. The high-temperature-stable hollow profile according to claim 1, wherein in cross-section the central region of the side walls has a length of at least 1/10 of a width of the profile and/or at least 1/10 of a height of the profile.

7. The high-temperature-stable hollow profile according to claim 1, wherein in cross-section the profile has a rectangular shape, a square shape, a rounded rectangular shape, or a rounded square shape.

8. The high-temperature-stable hollow profile according to claim 1, further comprising a fire resistant material.

9. The high-temperature-stable hollow profile of claim 1, wherein the silicon carbide is selected from recrystallized silicon carbide (RSiC), nitride-bonded silicon carbide (NSiC), reaction-bonded silicon infiltrated silicon carbide (SiSiC), densely sintered silicon carbide (SSiC) and/or mixtures thereof.

10. The high-temperature-stable hollow profile according to claim 3, wherein the angle is between 1° and 45° or between 5° and 20 °.

11. The high-temperature-stable hollow profile of claim 4, wherein the constant wall thickness is from 4 mm to 10 mm.

12. A high-temperature-stable hollow profile comprising at least one of silicon carbide, silicon nitride, and mullite, the high-temperature-stable hollow profile having side walls and transverse walls, wherein:

wall thicknesses of the side walls and of the transverse walls increase in cross-section from a central region to a corner region of the hollow profile;

a central region on the inside of a side wall is parallel to a corresponding outside of the side wall for a first length;

the central region on the inside of the side wall meets corner regions on the inside of the side wall each at a first angle, the first angle being an angle formed by an extrapolated plane of the central region on the inside of the side wall and a plane formed by a corner region of the inside of the side wall;

a central region on the inside of a transverse wall is parallel to a corresponding outside of the transverse wall for a second length;

the central region on the inside of the transverse wall meets corner regions on the inside of the side wall, each at a second angle, the second angle being an angle formed by an extrapolated plane of the central region on the inside of the transverse wall and a plane formed by the corner region of the inside of the transverse wall; and the corner region on the inside of the transverse wall meets the corner region on the inside of the side wall.

13. The high-temperature-stable hollow profile according to claim 12, wherein the first angle is less than the second angle.

14. The high-temperature-stable hollow profile according to claim 12, wherein the first angle and the second angle are between 1° and 45° or between 5° and 20°.

15. The high-temperature-stable hollow profile according to claim 12, wherein the hollow profile has at least one of a width of 30 mm to 200 mm, a height of 30 mm to 200 mm, or a length of 200 mm to 6000 mm.

16. The high-temperature-stable hollow profile according to claim 12, wherein in cross-section the central region of the side walls has a length of at least 1/10 of a height of the profile and/or at least 1/10 of a width of the profile.

17. The high-temperature-stable hollow profile according to claim 12, wherein in cross-section the profile has a rectangular square shape, a rounded rectangular, or a rounded square shape.

18. The high-temperature-stable hollow profile of claim 12, wherein the silicon carbide is selected from recrystallized silicon carbide (RSiC), nitride-bonded silicon carbide (NSiC), reaction-bonded silicon infiltrated silicon carbide (SiSiC), densely sintered silicon carbide (SSiC) and/or mixtures thereof.

19. The high-temperature-stable hollow profile according to claim 12, in which in cross-section the side walls and transverse walls have in the central region a constant wall thickness.

20. The high-temperature-stable hollow profile of claim 19, wherein the constant wall thickness is from 4 mm to 10 mm.

* * * * *

UNITED STATES PATENT AND TRADEMARK OFFICE

CERTIFICATE OF CORRECTION

PATENT NO. : 8,377,527 B2
APPLICATION NO. : 12/854833
DATED : February 19, 2013
INVENTOR(S) : Erhard Winkler It is certified that error appears in the above-identified patent and that said Letters Patent is hereby corrected as shown below:

In the Claims:

In column 3, line 48 (claim 1), please delete “as” and replace it with “at”

Signed and Sealed this
Seventh Day of May, 2013

Teresa Stanek Rea
*Acting Director of the United States Patent and Trademark Office*